US006666426B1

(12) United States Patent
Taylor

(10) Patent No.: US 6,666,426 B1
(45) Date of Patent: Dec. 23, 2003

(54) PILLOW HOLD FOR USE ON AN ADJUSTABLE SURFACE OF A BED

(76) Inventor: Ricky Taylor, P.O. Box 278, Linville Falls, NC (US) 28647

( * ) Notice: Subject to any disclaimer, the term of this patent is extended or adjusted under 35 U.S.C. 154(b) by 80 days.

(21) Appl. No.: 10/162,661

(22) Filed: Jun. 6, 2002

Related U.S. Application Data

(63) Continuation-in-part of application No. 09/400,984, filed on Sep. 22, 1999, now abandoned.

(51) Int. Cl.[7] ..... A47B 97/00
(52) U.S. Cl. ..... 248/506
(58) Field of Search ..... 248/500, 506, 248/508; 450/83, 86; 2/327; 5/498, 460, 636, 496; 24/302, 171, 300, 301, 725, 327, 328, 265, 498, 564

(56) References Cited

U.S. PATENT DOCUMENTS 1,858,787 A * 5/1932 Ottenheimer
3,346,892 A * 10/1967 Priest
4,084,299 A * 4/1978 Noda ..... 24/250
4,199,830 A * 4/1980 Ogata ..... 5/411
4,345,346 A * 8/1982 Holtz ..... 5/437
4,662,016 A * 5/1987 Seeman ..... 5/508
5,177,813 A * 1/1993 Bosack et al. ..... 2/323
5,675,841 A * 10/1997 Jackson ..... 2/175.7
5,785,011 A * 7/1998 Gitterman, III ..... 119/865
6,438,805 B1 * 8/2002 Goss et al. ..... 24/302

* cited by examiner

*Primary Examiner*—Gwendolyn Baxter
(74) *Attorney, Agent, or Firm*—Hunton & Williams LLP

(57) ABSTRACT

A pillow holding mechanism for use on an adjustable surface of a bed provides a holding mechanism. The holding mechanism prevents a pillow (or other support member) from falling down or shifting to an uncomfortable position when the adjustable surface is raised and/or lowered. The holding mechanism may include a first elastic strap attached to a pillow and a second elastic strap attached to an adjustable surface. A first clip attaches to a pillow and a second clip attaches to the adjustable surface. A third clip attaches the first elastic strap and the second elastic strap and further adjusts the overall length of the pillow holding mechanism.

6 Claims, 3 Drawing Sheets

PILLOW HOLD FOR USE ON AN ADJUSTABLE SURFACE OF A BED

CROSS REFERENCE TO RELATED APPLICATIONS

This is a Continuation in Part of U.S. patent application Ser. No. 09/400,984, filed Sep. 22, 1999, now abandoned, which is hereby incorporated by reference herein in its entirety.

FIELD OF THE INVENTION

The present invention relates generally to a mechanism for holding a pillow on an adjustable surface and more particularly, a mechanism for holding a pillow (or other support) in a desired position when an adjustable surface of a bed is raised and lowered.

BACKGROUND OF THE INVENTION

There are many types of adjustable beds and other furniture in the market that raise and lower the feet and head sections of reclining furniture. Many people enjoy sitting up on their beds to watch TV, eat a meal, read a paper or relax. These beds provide comfort and relief for sore backs and tired feet. However, it is difficult to keep a pillow at a particular position when the bed is raised and lowered. When the user gets up momentarily or shifts to a different position, the pillow will often fall off the bed or move to a position that is uncomfortable to the user. This is particularly inconvenient for patients or people with injuries, as movement may be difficult. Thus, there is a need for a device that holds the pillow or other resting aid in place when an adjustable bed is raised or lowered to a comfortable position.

SUMMARY OF THE INVENTION

According to an embodiment of the present invention, a pillow holding device for use on an adjustable surface member comprises a first elastic strap member having a first end removeably attachable to a pillow member and a second end removeably attached to an adjustment clip; a second elastic strap member having a first end removeably attachable to an adjustable surface member and a second end removeably attached to the adjustment clip wherein the adjustment clip adjusts a length of the pillow holding device; a first metal clip attached to the first end of the first elastic strap member wherein the first metal clip comprises a first plastic insert and a second plastic insert for engaging the pillow member; and a second metal clip attached to the first end of the second elastic strap member for attaching to the adjustable surface member.

Another aspects of the present invention include an additional strap member wherein the second metal clip wraps around a frame of a bed supporting the adjustable surface member and attaches to the additional strap member of the second elastic strap member; the first plastic insert comprising a plurality of protrusions in a first pattern and the second plastic insert comprising a plurality of protrusions in a second pattern, wherein the first pattern and the second pattern are complementary; the first pattern comprising four protrusions located at four corners of the first plastic insert having a rectangular shape; the second pattern comprising four protrusions located at a middle portion of four sides of the second plastic insert having a rectangular shape; and wherein the adjustable surface member is supported on a hospital bed.

DETAILED DESCRIPTION OF THE PREFERRED EMBODIMENTS

Figure 1:
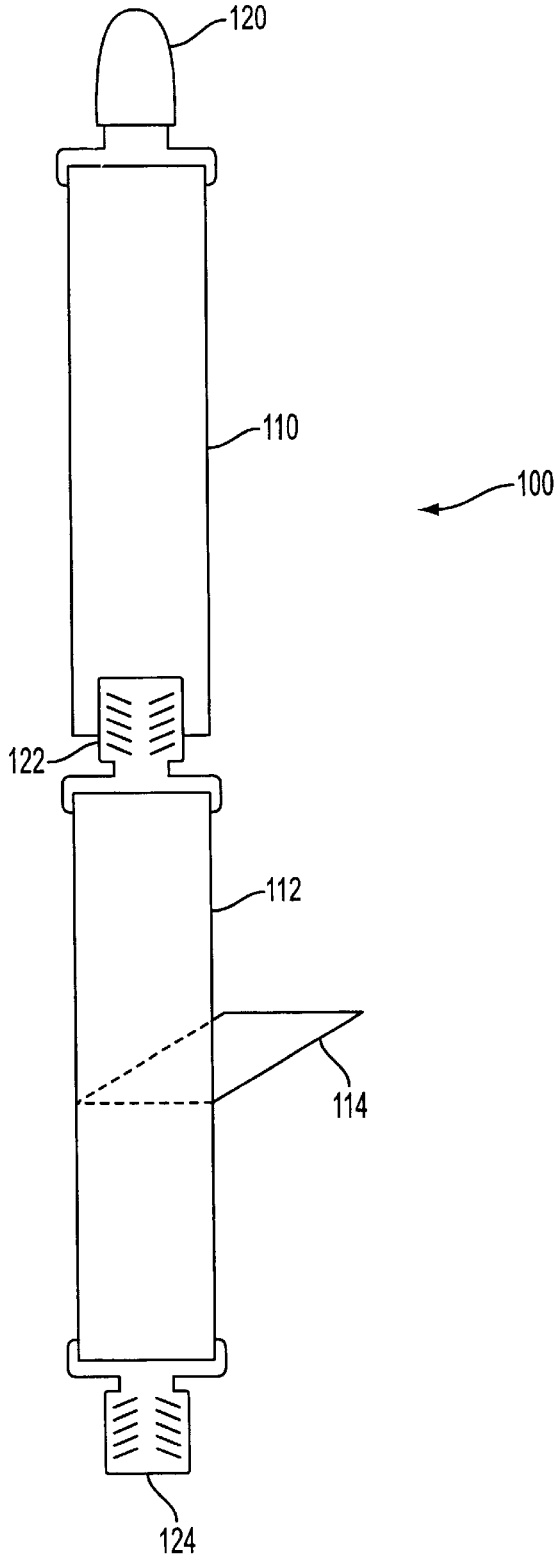
FIG. 1 is a diagram of a pillow hold mechanism, in accordance with the present invention.

FIG. 1 illustrates a pillow hold mechanism 100, in accordance with the present invention. The pillow hold mechanism 100 may include a first elastic strap 110 and a second elastic strap 112. In another embodiment of the present invention, the pillow hold mechanism may include a single elastic strap or a plurality of elastic straps. The straps may be made of an elastic material, cloth, flexible material or other durable material. A first metal clip 120 may be connected to a pillow or other support member, e.g., a cushion. A second metal clip 124 may be connected to a mattress, mattress cover or other adjustable surface capable of reclining, e.g., bed, armchair, sofa, etc. A third clip 122 may connect first elastic strap 110 and second elastic strap 112. Third clip 112 may be used to adjust the overall length of the pillow hold mechanism 100. Other adjustment mechanisms may be implemented in accordance with the present invention.

The pillow hold mechanism 100 may be used with an adjustable bed, such as a typical hospital bed with metal frames. In this case, second clip 124 may wrap around a metal frame (or other similar structure) and connect to strap 114.

Figure 2A:
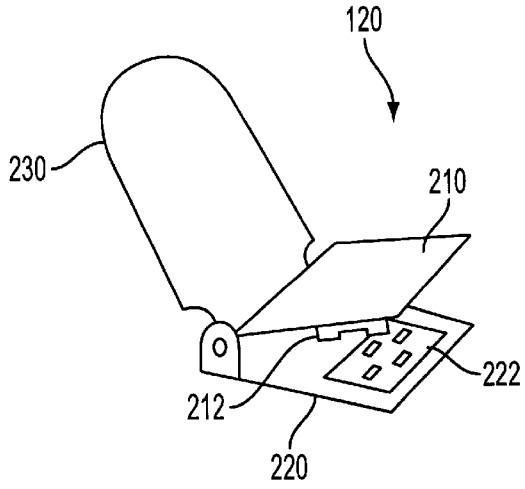
FIGS. 2A–2D are detailed views of the clips of a pillow hold mechanism, in accordance with the present invention.

FIGS. 2A–2D are detailed views of the clips of a pillow hold mechanism, in accordance with the present invention. FIG. 2A shows a detailed view of first clip 120. Clip member 230 may be used to open and close clip members 210 and 220. Clip member 210 may include a plastic insert 212 with protrusions having a first pattern. Clip member 220 may also include a plastic insert 222 with protrusions in a complementing second pattern.

Figure 2B:
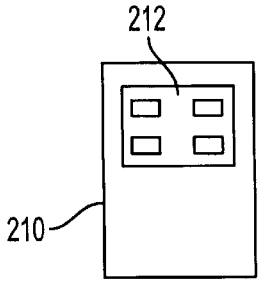
Figure 2C:
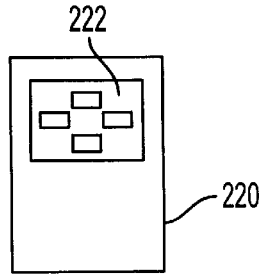

FIG. 2B shows clip member 210 with plastic insert 212 having protrusions with a first pattern. In this example, the protrusions are located in the four corners of a rectangular plastic insert. FIG. 2C shows clip member 220 with plastic insert 222 having protrusions with a complementing second pattern. In this example, the protrusions are located in a middle portion of the four sides of a rectangular plastic insert. Therefore, when clip member 230 is in a closed position, clip member 210 and clip member 212 may securely grip a pillow member. In particular, plastic inserts 212 and 222 may securely engage the pillow member.

Figure 2D:
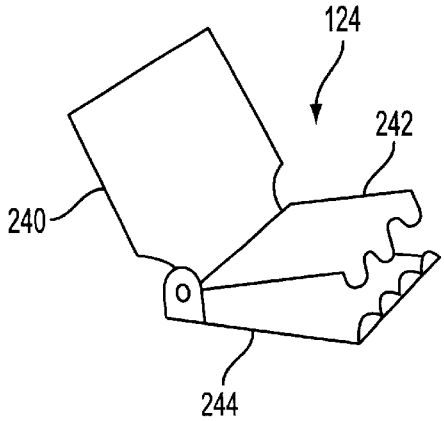

FIG. 2D shows a second clip 124 for securely gripping a mattress, mattress cover or other adjustable surface. FIG. 2D also illustrates a third clip 122. Clip member 240 may be used to open and close clip members 242 and 244. Clip members 242 and 244 may include groove members which securely attach to a mattress, mattress cover or other adjustable surface. In another embodiment of the present invention, second clip 124 may engage strap 114.

Figure 3A:
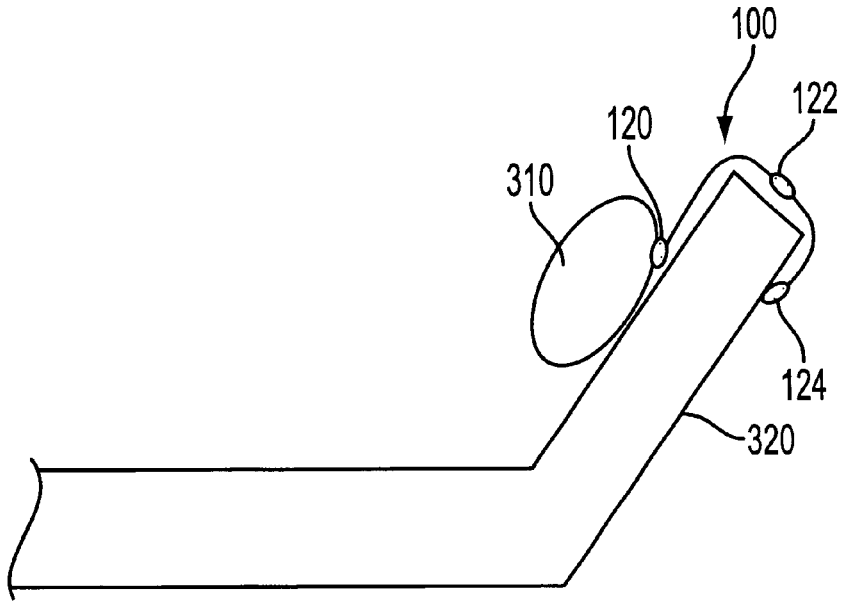
FIGS. 3A and 3B are side views of a pillow hold mechanism as used on an adjustable surface, in accordance with the present invention.
Figure 3B:
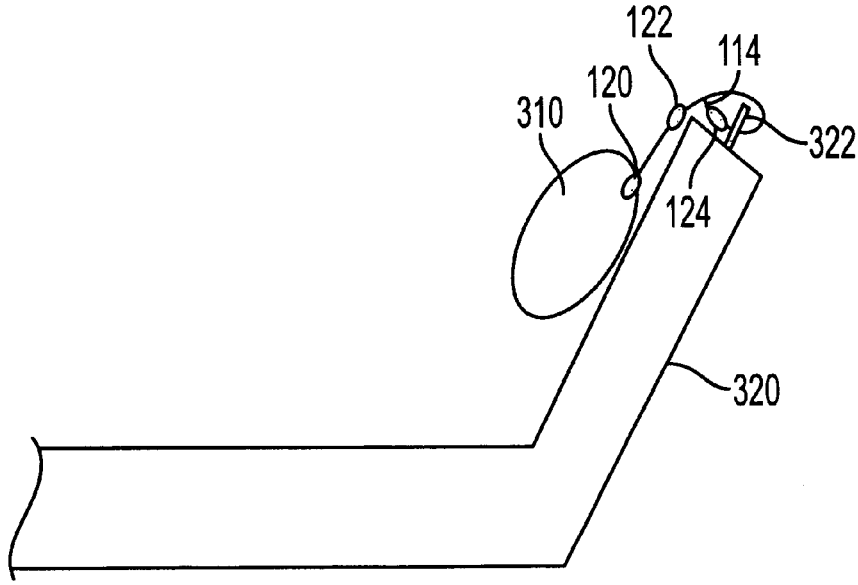

FIGS. 3A and 3B are side views of a pillow hold mechanism as used on an adjustable surface, in accordance with the present invention. FIG. 3A illustrates an embodiment of the present invention, in which a pillow 310 is attached to a pillow hold mechanism 100 that is attached to an adjustable surface 320 of a bed. A first clip 120 may be attached to the pillow 310 and a second clip 124 may be attached to the adjustable surface 320. A third clip 122 may be used to adjust the overall length of the pillow hold mechanism as well as the position of pillow 310.

FIG. 3B illustrates another embodiment of the present invention, in which a pillow 310 is attached to a pillow hold mechanism 100 that is attached to an adjustable surface 320 of a bed. A first clip 120 may be attached to the pillow 310. A second clip 124 may be wrapped around a metal frame 322 (or other frame portion of a bed) and attached to strap 114 of the pillow hold mechanism 100.

In accordance with the present invention, the pillow 310 may represent a cushion or other support member. Clip members may also include a fastener, snaps, velcro or other similar attachment devices. The present invention may also be used to hold a foot support at a foot portion of an adjustable surface. In addition, two or more pillows with two or more separate attachment elements for each pillow may also be implemented in accordance with the present invention.

Other embodiments and uses of the invention will be apparent to those skilled in the art from consideration of the specification and practice of the invention. For instance, the pillow hold may be used on other types of reclining furniture, such as sofas, recliners, chairs or FUTONS®. Also, the scope of the invention is not restricted to pillows. Other types of support elements may also be used such as cushions, head rests, back rests, feet rests and other elevating supports. The specification and examples should be considered exemplary only. The scope of the invention is intended to be limited only by the appended claims.

What is claimed is:

1. A pillow holding device for holding a pillow member in place on an adjustable elevated surface member, comprising:

a first elastic strap member having a first end removeably attachable to the pillow member and a second end removeably attached to an adjustment clip;

a second elastic strap member having a first end removeably attachable to an adjustable surface member and a second end attached to the adjustment clip wherein the adjustment clip adjusts a length of the pillow holding device wherein the second elastic strap member is separate and distinct from the first elastic strap member;

a first metal clip attached to the first end of the first elastic strap member wherein the first metal clip comprises a first plastic insert and a second plastic insert for engaging the pillow member; and a second metal clip attached to the first end of the second elastic strap member for attaching to the adjustable elevated surface member wherein the second metal clip is separate and distinct from the first metal clip;

wherein the pillow member is held in place on the adjustable surface member when the adjustable surface member is elevated.

2. The pillow holding device of claim 1, wherein the second elastic strap member comprises an additional strap member wherein the second metal clip wraps around a frame of a bed supporting the adjustable surface member and attaches to the additional strap member of the second elastic strap member.

3. The pillow holding device of claim 1, wherein the first plastic insert comprises a plurality of protrusions in a first pattern and the second plastic insert comprises a plurality of protrusions in a second pattern, wherein the first pattern and the second pattern are complementary.

4. The pillow holding device of claim 3, wherein the first pattern comprises four protrusions located at four corners of the first plastic insert having a rectangular shape.

5. The pillow holding device of claim 4, wherein the second pattern comprises four protrusions located at a middle portion of four sides of the second plastic insert having a rectangular shape.

6. The pillow holding device of claim 1, wherein the adjustable surface member is supported on a hospital bed.

* * * * *